US011320116B2

(12) United States Patent
Liu

(10) Patent No.: US 11,320,116 B2
(45) Date of Patent: May 3, 2022

(54) INTEGRATED LED LIGHT

(71) Applicant: David Da Liu, Rancho Cucamonga, CA (US)

(72) Inventor: David Da Liu, Rancho Cucamonga, CA (US)

( * ) Notice: Subject to any disclaimer, the term of this patent is extended or adjusted under 35 U.S.C. 154(b) by 0 days.

(21) Appl. No.: 16/875,733

(22) Filed: May 15, 2020

(65) Prior Publication Data

US 2021/0356098 A1 Nov. 18, 2021

(51) Int. Cl.

| | |
|---|---|
| ***F21V 14/06*** | (2006.01) |
| ***F21V 23/00*** | (2015.01) |
| ***F21V 23/04*** | (2006.01) |
| ***F21V 5/04*** | (2006.01) |
| ***F21V 21/30*** | (2006.01) |
| ***F21V 21/08*** | (2006.01) |
| ***F21V 23/06*** | (2006.01) |
| *F21Y 115/10* | (2016.01) |

(52) U.S. Cl.

CPC ..... *F21V 14/06* (2013.01); *F21V 5/04* (2013.01); *F21V 21/0824* (2013.01); *F21V 21/30* (2013.01); *F21V 23/009* (2013.01); *F21V 23/04* (2013.01); *F21V 23/06* (2013.01); *F21Y 2115/10* (2016.08)

(58) Field of Classification Search

CPC ..... F21Y 2115/10; F21V 23/007–009

See application file for complete search history.

(56) References Cited

U.S. PATENT DOCUMENTS

| | | | | |
|---|---|---|---|---|
| 10,323,832 | B2 | 6/2019 | Erdener et al. | |
| 10,465,888 | B1 | 11/2019 | Erdener et al. | |
| 10,823,377 | B1 * | 11/2020 | Hsu | F21V 14/06 |
| 2015/0260385 | A1 * | 9/2015 | Brynjolfsson | H05B 47/195 315/152 |
| 2016/0224315 | A1 * | 8/2016 | Zhang | H05B 31/50 |
| 2017/0167695 | A1 * | 6/2017 | Erdener | F21V 21/30 |
| 2019/0037663 | A1 * | 1/2019 | Van Winkle | H05B 45/20 |
| 2020/0340651 | A1 * | 10/2020 | Huang | F21V 29/70 |

* cited by examiner

*Primary Examiner* — Rajarshi Chakraborty
*Assistant Examiner* — Michael Chiang

(57) ABSTRACT

An integrated light emitting diode (LED) device includes an LED light source coupled to a base. The device also includes a controller coupled to a bottom portion of the base. The device also includes a switch coupled to the controller, the switch toggling the controller. The device also includes a controller box comprising an aperture coupled to the base, the controller box encasing the controller and a portion of the switch, an actuator of the switch extending through the aperture. The device also includes an electrical coupler coupled to a recess of the controller box. The device also includes a lens holder coupled to a top portion of the base. The device also includes a lens coupled to the lens holder.

19 Claims, 7 Drawing Sheets

INTEGRATED LED LIGHT

TECHNICAL FIELD

The present disclosure generally relates to light emitting diodes (LEDs), and more particularly to integrated LED lights.

BACKGROUND

LED lights are an energy efficient option for providing illumination. LEDs also generally have a significantly longer lifespan than incandescent lights. As a result, LED lighting applications have become increasingly popular for a wide variety of purposes.

BRIEF SUMMARY

The subject disclosure provides for a modular and removable integrated light emitting diode (LED) light. According to one embodiment of the present disclosure, an integrated LED device includes an LED light source coupled to a base. The device also includes a controller coupled to a bottom portion of the base. The device also includes a switch coupled to the controller, the switch toggling the controller. The device also includes a controller box comprising an aperture coupled to the base, the controller box encasing the controller and a portion of the switch, an actuator of the switch extending through the aperture. The device also includes an electrical coupler coupled to a recess of the controller box. The device also includes a lens holder coupled to a top portion of the base. The device also includes a lens coupled to the lens holder.

According to one embodiment of the present disclosure, an integrated light emitting diode (LED) device includes a housing having a lamp shade coupled to a tailstock. The housing encasing an LED light source coupled to a base. The housing also encases a controller coupled to a bottom portion of the base. The housing also encases a switch coupled to the controller, the switch toggling the controller. The housing also encases a controller box comprising an aperture coupled to the base, the controller box encasing the controller and a portion of the switch, an actuator of the switch extending through the aperture. The housing also encases an electrical coupler coupled to a recess of the controller box. The housing also encases a lens holder coupled to a top portion of the base. The housing also encases a lens coupled to the lens holder.

According to one embodiment of the present disclosure, an integrated lighting device includes a housing having a lamp shade coupled to a tailstock. The tailstock may be coupled to a ground plug. The housing may encase an integrated LED device. The LED device may include an LED light source coupled to a base. The LED device may also include a controller coupled to a bottom portion of the base. The LED device may also include a switch coupled to the controller, the switch toggling the controller. The LED device may also include a controller box comprising an aperture coupled to the base, the controller box encasing the controller and a portion of the switch, an actuator of the switch extending through the aperture. The LED device may also include an electrical coupler coupled to a recess of the controller box. The LED device may also include a lens holder coupled to a top portion of the base. The LED device may also include a lens coupled to the lens holder. The LED device may also include a focusing ring coupled to the top portion of the base, the focusing ring encasing the lens, the lens holder, and the LED light source.

BRIEF DESCRIPTION OF THE DRAWINGS

To easily identify the discussion of any particular element or act, the most significant digit or digits in a reference number refer to the figure number in which that element is first introduced.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

In the following detailed description, numerous specific details are set forth to provide a full understanding of the present disclosure. It will be apparent, however, to one ordinarily skilled in the art that the embodiments of the present disclosure may be practiced without some of these specific details. In other instances, well-known structures and techniques have not been shown in detail so as not to obscure the disclosure.

LED lights are an energy efficient option for providing illumination. LEDs also generally have a significantly longer lifespan than incandescent lights. As a result, LED lighting applications have become increasingly popular for a wide variety of purposes. Accordingly, there is a need for convenient LED lighting applications that are user-friendly.

Aspects of the present disclosure address this need by providing for a modular and removable integrated light emitting diode (LED) light. According to one embodiment of the present disclosure, an integrated LED device includes an LED light source coupled to a base. The device also includes a controller coupled to a bottom portion of the base. The device also includes a switch coupled to the controller, the switch toggling the controller. The device also includes a controller box comprising an aperture coupled to the base, the controller box encasing the controller and a portion of the switch, an actuator of the switch extending through the aperture. The device also includes an electrical coupler coupled to a recess of the controller box. The device also includes a lens holder coupled to a top portion of the base. The device also includes a lens coupled to the lens holder.

The disclosed integrated LED device improves upon conventional LED technology by making it easier for users to switch LED lamps from a casing. Additionally, the casing provides protection for the LED lamp. In this way, users may conveniently interchange different LED lamps with different casings for a wide variety of lighting applications.

Figure 1:
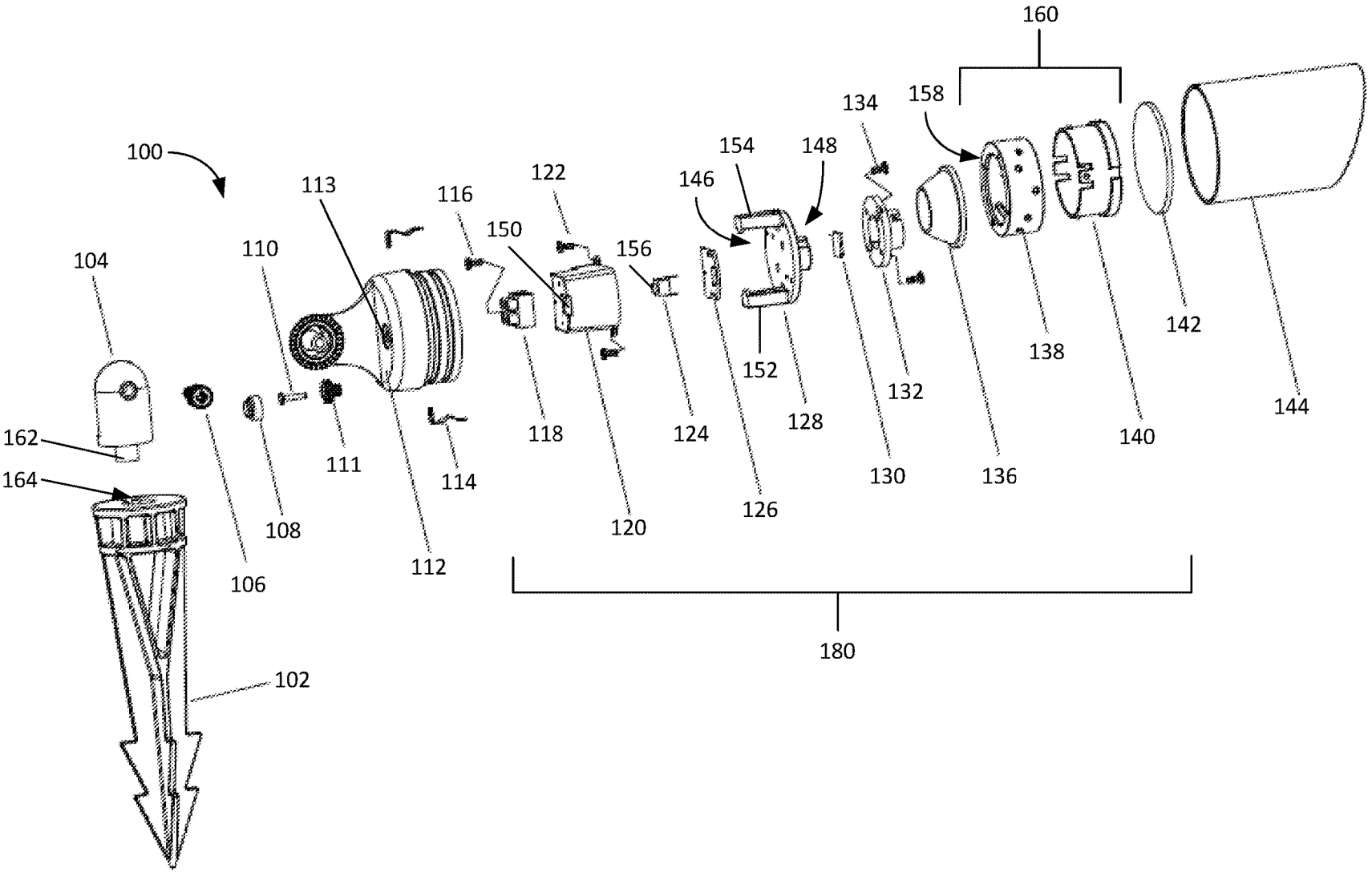
FIG. 1 illustrates an exploded view of an LED device, according to certain aspects of the present disclosure.

FIG. 1 illustrates an exploded view of an LED device 100, according to certain aspects of the present disclosure. The LED device 100 may include a removable LED module 180 (e.g., an integrated LED device). The module 180 may include an LED light source 130, a base 128, a controller 126, a switch 124, a controller box 120, an electrical coupler 118, a lens holder 132, a lens 136, and a focusing ring 160.

According to aspects, the LED light source 130 may be coupled to the base 128. The controller 126 may be coupled to a bottom portion 146 of the base 128. For example, the controller 126 may include controller circuitry. The switch 124 may be coupled to the controller 126. For example, the switch 124 may be configured to toggle the controller 126. According to aspects, the switch may be square shaped.

Figure 2:
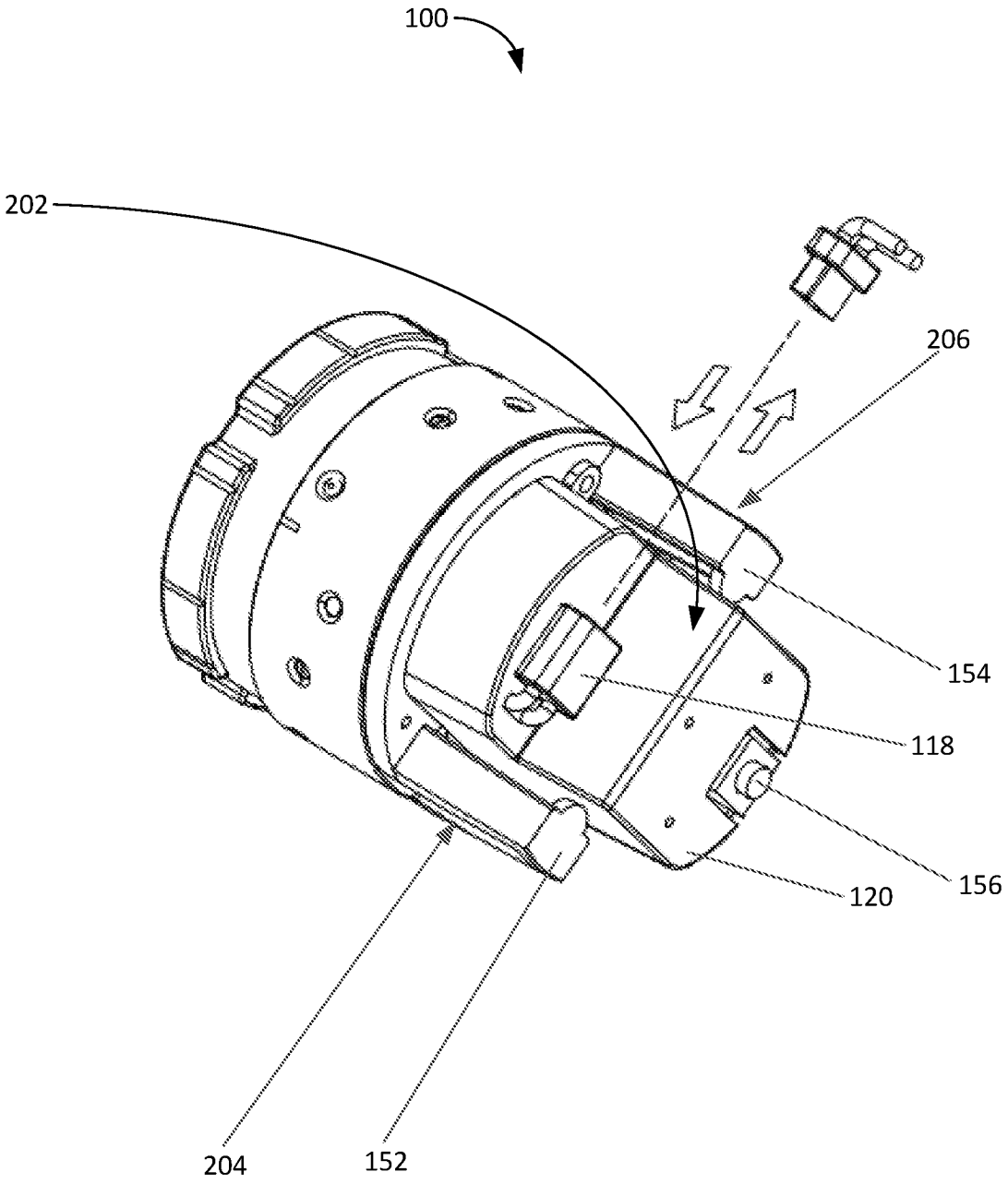
FIG. 2 illustrates a perspective back view of the LED device of FIG. 1 when assembled, according to certain aspects of the present disclosure.

The controller box 120 may be coupled to the base 128. For example, the controller box 120 may include an aperture 150. In an implementation, the controller box 120 may encase the controller 126 and a portion of the switch 124. An actuator 156 of the switch 124 may extend through the aperture 150 (e.g., as shown in FIG. 2). For example, the actuator 156 may adjust a wattage/lumens output (e.g., power output) of the light source 130 from a range of 200-600 lumens. In an implementation, pressing the actuator 156 may adjust the wattage output from 3 W (e.g., 240 lumens), to 5 W (e.g., 370 lumens), to 7 W (e.g., 490 lumens) with each press. For example, the actuator 156 may be a button or a dial for adjustment of the wattage/lumens output.

The electrical coupler 118 may be coupled to a recess 202 (as shown in FIG. 2) of the controller box 120. The lens holder 132 may be coupled to a top portion 148 of the base 128. The lens 136 may be coupled to the lens holder 132. As described herein, coupling may be accomplished through various means, including, but not limited to, screws, friction fit, welding, glue, etc.

According to aspects, the focusing ring 160 may include an outer ring 138 coupled to an inner ring 140. For example, a bottom portion 158 of the outer ring 138 may abut the top portion 148 of the base 128. The focusing ring 160 may further be coupled to the top portion 148 of the base 128. For example, the focusing ring 160 may encase the lens 136, the lens holder 132, and the LED light source 130.

According to aspects, the base 128 may include a first arm 152 and a second arm 154, such that the first arm 152 and the second arm 154 extend around opposite sides of the controller box 120.

According to aspects, a housing for the module 180 may include a lamp shade 144 coupled to a tailstock 112 (e.g., a base mount). For example, the housing may encase the module 180 such that the module 180 may be easily removed/replaced from the housing. The tailstock 112 may also be coupled to a ground plug 102. According to an aspect, the lamp shade 144 may encase the focusing ring 160. The lamp shade 144 may further encase a transparent covering 142. For example, the transparent covering 142 may abut the focusing ring 160. According to aspects the transparent covering 142 may be glass, plastic, crystal, or the like.

According to aspects, the ground plug 102 may be coupled to the tailstock 112 through a grounding connector 104. For example, the grounding connector 104 may be configured to couple with the tailstock 112 through a screw 106. An abutment 162 of the grounding connector 104 may be configured to couple with a recess 164 of the ground plug 102.

According to aspects, the tailstock 112 may include an aperture 113 that aligns with the actuator 150 such that the actuator 150 may be accessed through the tailstock 112. For example, a switch nail 110 may be supported by a switch nut 111 through the aperture 113. A covering 108 may cover the switch nail 110 and the switch nut 111. For example, the switch nail 110 may be plastic, and may be aligned with the actuator 150 such that pressing the switch nail 110 causes the switch nail 110 to press against the actuator 150. Thus, the wattage/lumens output of the LED device 100 may be adjusted through the tailstock 112.

According to aspects, the module 180 may be held in place inside the tailstock 112 through springs 114. For example, the springs 114 may couple with each of the first arm 152 and the second arm 154 to hold the module 180 in place. According to aspects, the tailstock 112 may include interior grooves (not shown) that couple with the springs 114 for holding the module 180 in place. For example, the interior grooves may align with each of the first arm 152 and the second arm 154 so that the springs 114 may clip into each of the first arm 152 and the second arm 154. It is understood that more or less than two springs may be utilized without departing from the scope of the disclosure.

According to aspects, the electrical coupler 118 may be coupled to the controller box 120 via a screw 116. The controller box 120 may be coupled to the bottom portion 146 of the base 128 via screws 122. The lens holder 132 may be coupled to the top portion 148 of the base 128 via screws 134. According to aspects, the electrical coupler 118 may include a quick connector. For example, the quick connector allows for quick electrical coupling of the LED device 100 to a power source (e.g., a transformer).

It is understood that a shape of the housing may be configured for various lighting implementations (e.g., outdoor, indoor, ground, ceiling, etc.). In this way the housing and the module 180 may be interchangeable with each other to provide greater flexibility in lighting applications for users. For example, the housing as illustrated may be configured to be mounted in the ground (e.g., via the ground plug 102). In alternative configurations, the housing may also be configured for a ceiling mount, or any other type of mount for any other purpose.

Figure 3:
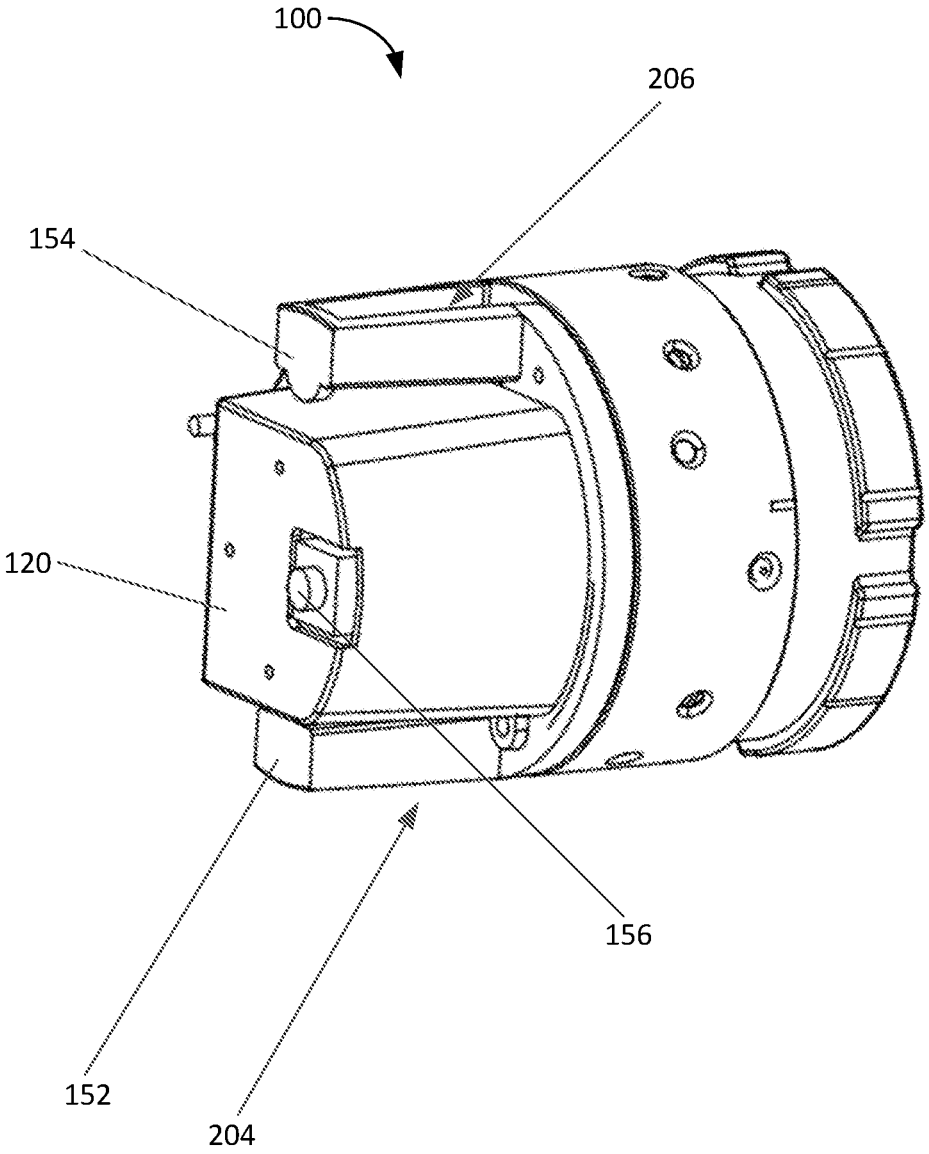
FIG. 3 illustrates another perspective back view of the LED device of FIG. 1 when assembled, according to certain aspects of the present disclosure.

FIGS. 2 and 3 illustrate perspective views of the LED device 100 of FIG. 1 when assembled, according to certain aspects of the present disclosure. As illustrated, the controller box 120 may include a recess 202 for supporting and coupling with the electrical coupler 118. The electrical coupler 118 may include a wiring base. For example, the recess 202 may be substantially square-shaped. According to aspects, the actuator 156 may include a button.

According to aspects, each of the first arm 152 and the second arm 154 may be substantially trapezoidal in shape with hollow portions 204 and 206. The hollow portions 204, 206 provide stability and reduce weight for the device 100.

Figure 4:
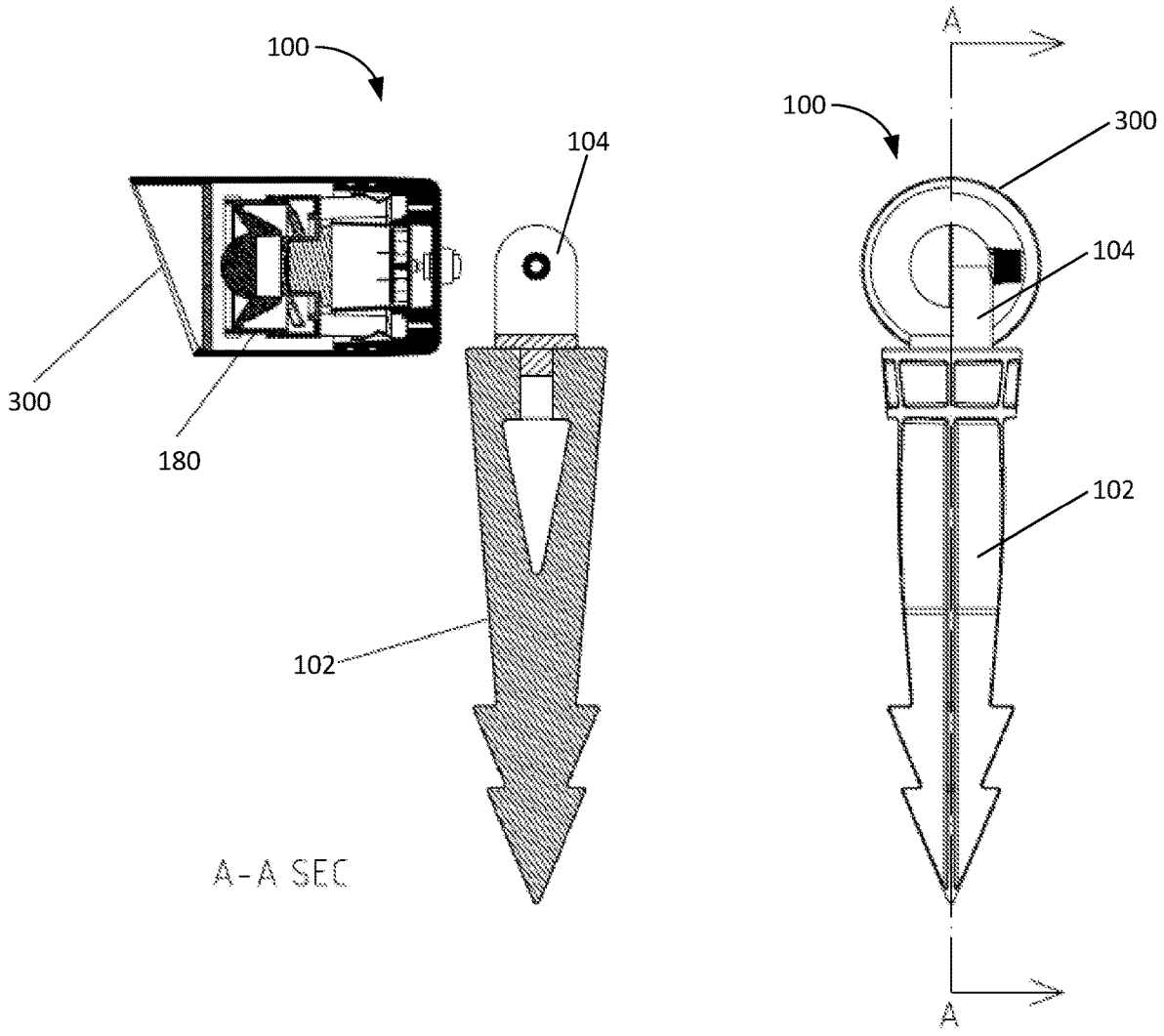
FIG. 4 illustrates a cross-sectional side view of the LED device of FIG. 1 taken across line A-A, according to certain aspects of the present disclosure.

FIG. 4 illustrates a cross-sectional side view of the LED device 100 of FIG. 1 taken across line A-A, according to certain aspects of the present disclosure. As illustrated, the module 180 (e.g., integrated LED device) fits snugly inside a housing 300 (e.g., the lamp shade 144 coupled to the tailstock 112). The housing 300 may be coupled to the ground plug 102 via the grounding connector 104.

Figure 5:
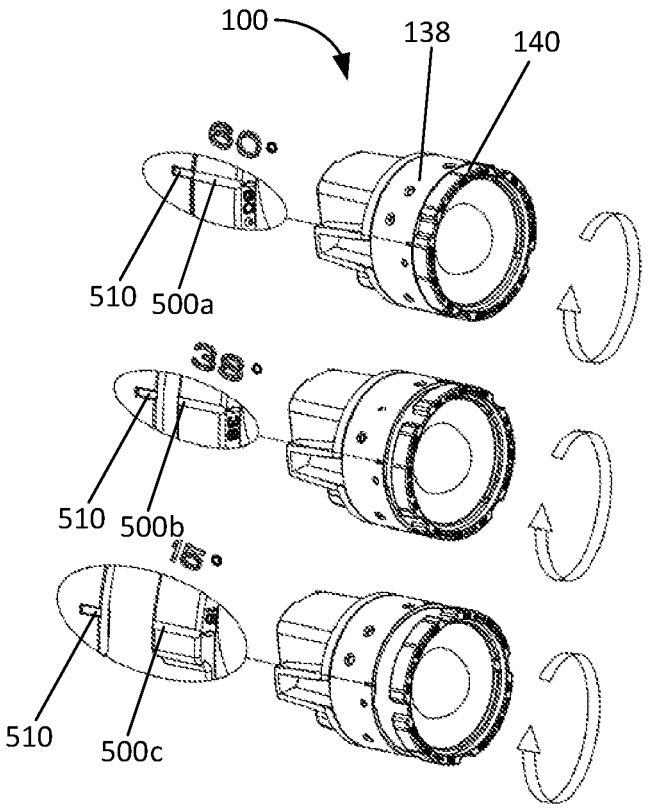
FIG. 5 illustrates adjustment of a beam angle, according to certain aspects of the present disclosure.
Figure 6:
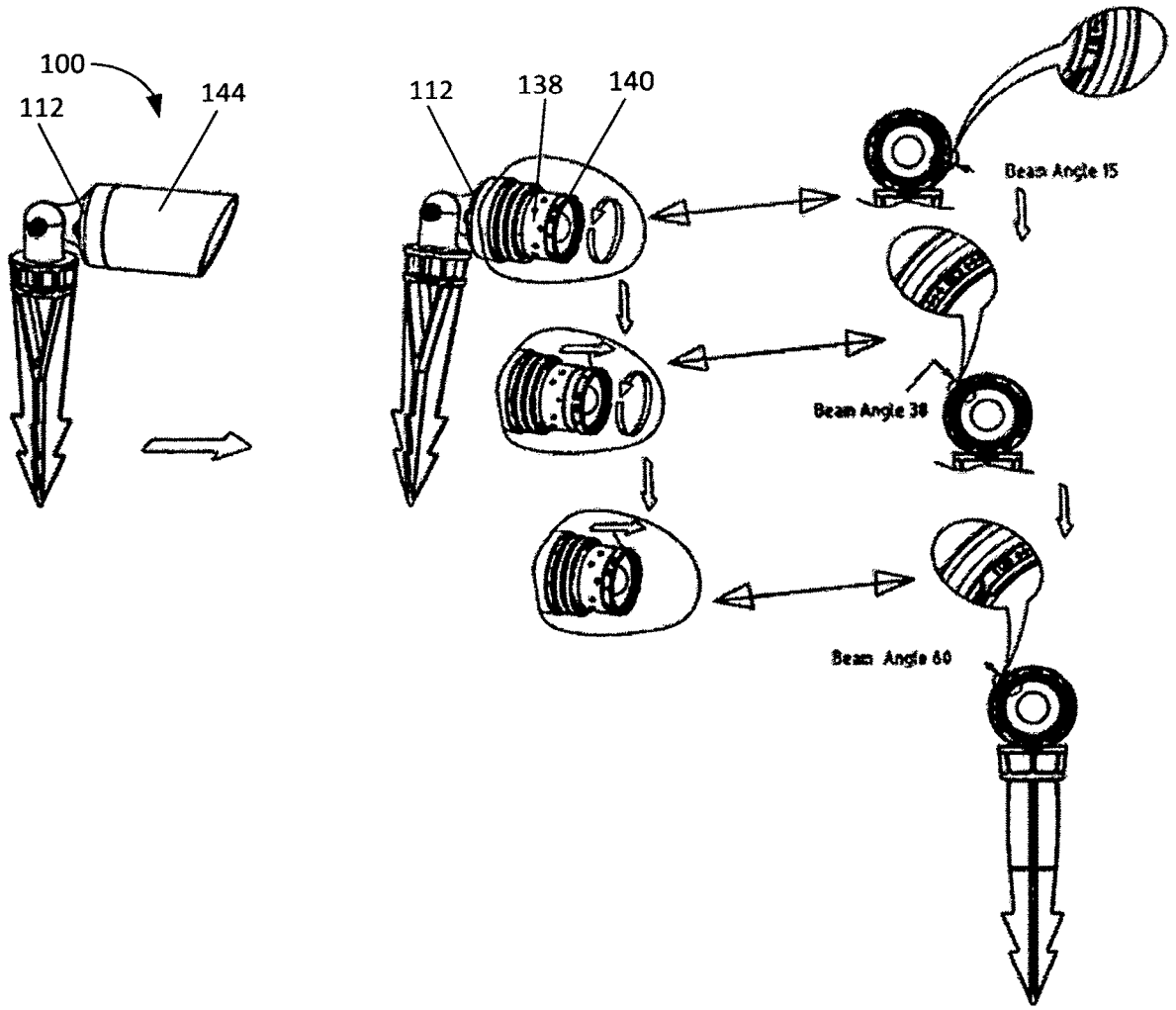
FIG. 6 illustrates additional aspects of adjustment of a beam angle, according to certain aspects of the present disclosure.

FIGS. 5 and 6 illustrate adjustment of a beam angle, according to certain aspects of the present disclosure. According to aspects, the inner ring 140 may freely rotate about the outer ring 138 to provide adjustments to a beam angle of light emitted from the device 100. For example, the beam angle may range between 10 degrees and 75 degrees. According to aspects, a border of the inner ring 140 may include markers 500 that indicate corresponding beam angles. For example, when the inner ring 140 is rotated based on the markers 500, beam angles of 15 degrees, 38 degrees, and/or 60 degrees may be reached. It is understood that the markers 500 may be included for any angle.

According to aspects, a first marker 500*a* may correspond to a first angle (e.g., 60 degrees), a second marker 500*b* may correspond to a second angle (e.g., 38 degrees), and a third marker 500*c* may correspond to a third angle (e.g., 15 degrees). For example, the markers 500 may include indentations on the inner 140 that align with an outer indentation 510 of the outer ring 138.

According to aspects, the inner ring 140 may telescope outwards from the outer ring 138 as the angles are adjusted from the first angle, to the second angle, to the third angle. For example, the inner ring 140 may telescope outwards to a maximum of 0.75 inches. It is understood that other telescoping lengths may be implemented for other angles without departing from the scope of the disclosure.

Referring to FIG. 6, it is illustrated how the beam angle may be adjusted when the LED device 100 is coupled to the tailstock 112. For example, the lamp shade 144 may first be removed to expose the front portion of the LED device 100.

According to aspects, the lamp shade 144 may be friction fit onto the tailstock 112. This allows free rotation of the lamp shade 144 to stay in place at any orientation for flexibility in lighting applications. Once the lamp shade 144 is removed, the beam angle may be adjusted by rotating the inner ring 140 as described above.

It is understood that the beam angle may be adjust by rotating the inner ring 140 either clockwise or counter-clockwise with respect to the outer ring 138. For example rotating the inner ring 140 clockwise may adjust the beam angle from 15 degrees, to 38 degrees, to 60 degrees. Alternatively, rotating the inner ring 140 counter-clockwise may adjust the beam angle from 15 degrees, to 38 degrees, to 60 degrees. It is understood that rotating the inner ring 140 the opposite direction would cause the opposite to happen in each of the previously mentioned scenarios.

The techniques described herein may be implemented as method(s) that are performed by physical computing device (s); as one or more non-transitory computer-readable storage media storing instructions which, when executed by computing device(s), cause performance of the method(s); or, as physical computing device(s) that are specially configured with a combination of hardware and software that causes performance of the method(s).

Figure 7:
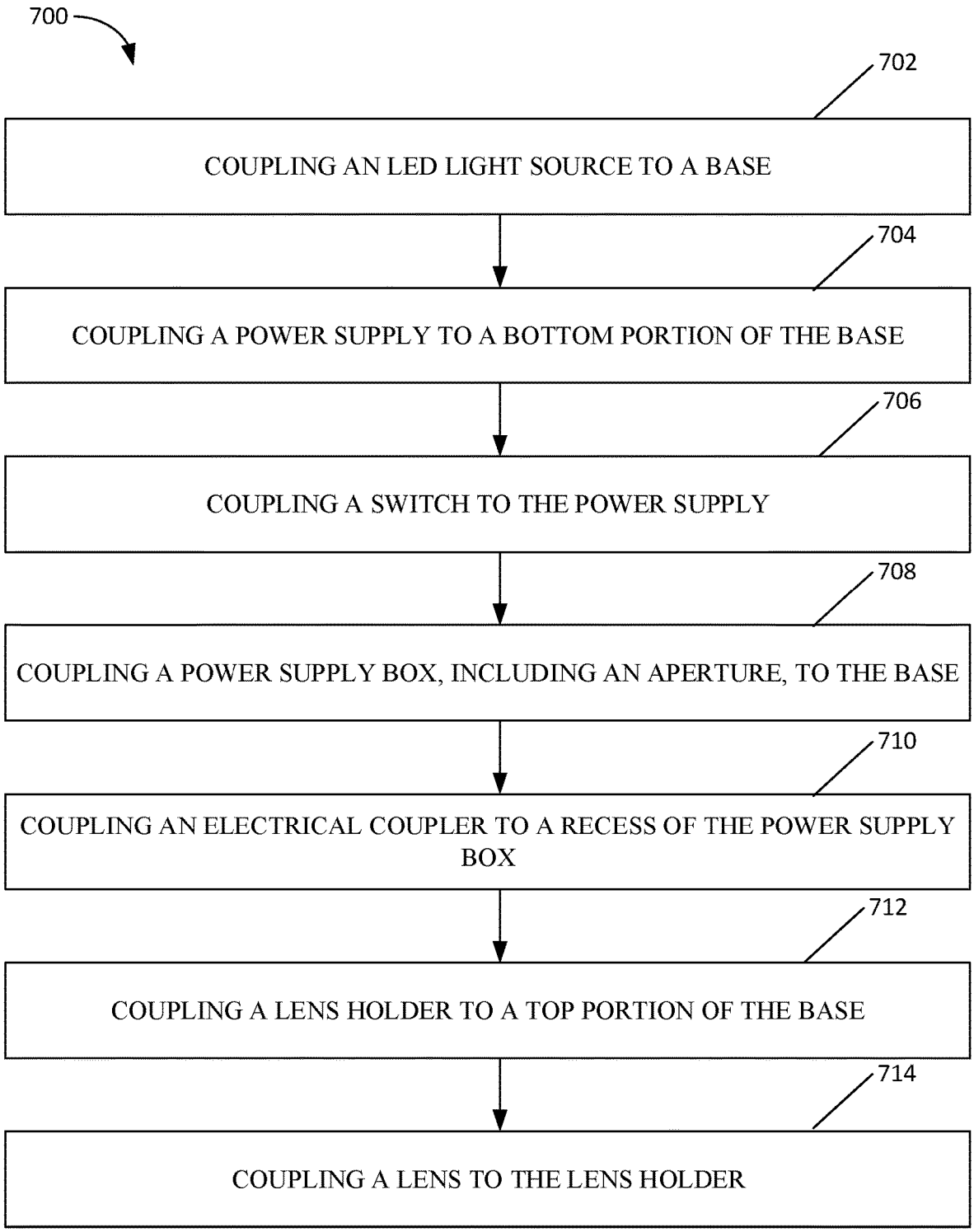
FIG. 7 illustrates an example flow diagram for assembling an LED device, according to certain aspects of the disclosure.

FIG. 7 illustrates an example flow diagram (e.g., process 700) for assembling an LED device, according to certain aspects of the disclosure. For explanatory purposes, the example process 700 is described herein with reference to FIGS. 1-6. Further for explanatory purposes, the steps of the example process 700 are described herein as occurring in serial, or linearly. However, multiple instances of the example process 700 may occur in parallel. For purposes of explanation of the subject technology, the process 700 will be discussed in reference to FIGS. 1-7.

At step 702, an LED light source 130 is coupled to a base 128.

At step 704, a controller 126 is coupled to a bottom portion 146 of the base 128.

At step 706, a switch 124 is coupled to the controller 126. The switch 124 may toggle the controller 126.

At step 708 a controller box 120 including an aperture 150 is coupled to the base 128. The controller box 120 may encase the controller 126 and a portion of the switch 124. An actuator 156 of the switch 124 may extend through the aperture 150.

At step 710, an electrical coupler 118 is coupled to a recess 202 of the controller box 120.

At step 712, a lens holder 132 is coupled to a top portion 148 of the base 128.

At step 714, a lens 136 is coupled to the lens holder 132.

According to an aspect, the base 128 includes a first arm 152 and a second arm 154.

According to an aspect, the first arm 152 and the second arm 154 extend around opposite sides of the controller box 120.

According to an aspect, the recess 202 is substantially square shaped.

According to an aspect, the electrical coupler 118 includes a wiring base or a quick connector.

According to an aspect, the actuator 156 includes a button.

According to an aspect, the switch 124 is substantially square shaped.

According to an aspect, the process 700 further includes coupling a focusing ring 160 to the top portion 148 of the base 128. The focusing ring 160 may encase the lens 136, the lens holder 132, and the LED light source 130.

According to an aspect, the focusing ring 160 may include an outer ring 138 coupled to an inner ring 140. For example, a bottom portion 158 of the outer ring 138 abuts the top portion 148 of the base 128.

According to an aspect, the inner ring 140 freely rotates to provide adjustments to a beam angle of light emitted from the LED light source 130.

According to an aspect, the process 700 further includes coupling a lamp shade 144 coupled to a tailstock 112 to form a housing for an integrated lighting device (e.g., module 180).

According to aspects, the tailstock 112 may be coupled to a ground plug 102.

According to aspects, the lamp shade 144 encases the focusing ring 160 and a transparent covering 142.

According to aspects, the transparent covering 142 abuts the focusing ring 160.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the terms "include", "have", or the like is used in the description or the claims, such term is intended to be inclusive in a manner similar to the term "comprise" as "comprise" is interpreted when employed as a transitional word in a claim. The word "exemplary" is used herein to mean "serving as an example, instance, or illustration". Any embodiment described herein as "exemplary" is not necessarily to be construed as preferred or advantageous over other embodiments.

A reference to an element in the singular is not intended to mean "one and only one" unless specifically stated, but rather "one or more". All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment.

Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed to achieve desirable results. The actions recited in the claims can be performed in a different order and still achieve desirable results. As one example, the processes depicted in the accompanying figures do not necessarily require the particular order shown, or sequential order, to achieve desirable results.

In certain circumstances, multitasking and parallel processing may be advantageous. Moreover, the separation of various system components in the aspects described above should not be understood as requiring such separation in all aspects, and it should be understood that the described program components and systems can generally be integrated together in a single software product or packaged into multiple software products. Other variations are within the scope of the following claims.

What is claimed is:

1. An integrated light emitting diode (LED) device, comprising:

an LED light source coupled to a base, the base comprising a first arm and a second arm, the first arm and the second arm each comprising trapezoids with hollow portions;

springs configured to couple with each of the first arm and the second arm to hold the base in place;

a controller coupled to a bottom portion of the base;

a switch coupled to the controller, the switch toggling the controller;

a controller box comprising an aperture coupled to the base, the controller box encasing the controller and a portion of the switch, an actuator of the switch extending through the aperture;

an electrical coupler coupled to a recess of the controller box;

a lens holder coupled to a top portion of the base; and a lens coupled to the lens holder.

2. The integrated LED device of claim 1, wherein the first arm and the second arm extend around opposite sides of the controller box.

3. The integrated LED device of claim 1, wherein the recess is substantially square shaped.

4. The integrated LED device of claim 1, wherein the electrical coupler comprises a wiring base.

5. The integrated LED device of claim 1, wherein the electrical coupler comprises a quick connector.

6. The integrated LED device of claim 1, wherein the actuator comprises a button.

7. The integrated LED device of claim 1, wherein the switch is square shaped.

8. The integrated LED device of claim 1, further comprising:

a focusing ring coupled to the top portion of the base, the focusing ring encasing the lens, the lens holder, and the LED light source.

9. The integrated LED device of claim 8, wherein the focusing ring comprises an outer ring coupled to an inner ring, such that a bottom portion of the outer ring abuts the top portion of the base.

10. The integrated LED device of claim 9, wherein the inner ring freely rotates to provide adjustments to a beam angle of light emitted from the LED light source.

11. The integrated LED device of claim 9, wherein the beam angle ranges between 10 degrees and 75 degrees.

12. An integrated light emitting diode (LED) device, comprising:

a housing comprising a lamp shade coupled to a base mount, the housing encasing:

an LED light source coupled to a base, the base comprising a first arm and a second arm, the first arm and the second arm each comprising trapezoids with hollow portions;

springs configured to couple with each of the first arm and the second arm to hold the base in place;

a controller coupled to a bottom portion of the base;

a switch coupled to the controller, the switch toggling the controller;

a controller box comprising an aperture coupled to the base, the controller box encasing the controller and a portion of the switch, an actuator of the switch extending through the aperture;

an electrical coupler coupled to a recess of the controller box;

a lens holder coupled to a top portion of the base; and a lens coupled to the lens holder.

13. The integrated LED device of claim 12, further comprising:

a focusing ring coupled to the top portion of the base, the focusing ring encasing the lens, the lens holder, and the LED light source.

14. The integrated LED device of claim 13, wherein the focusing ring comprises an outer ring coupled to an inner ring, such that a bottom portion of the outer ring abuts the top portion of the base.

15. The integrated LED device of claim 14, wherein the inner ring freely rotates to provide adjustments to a beam angle of light emitted from the LED light source.

16. The integrated LED device of claim 13, wherein the lamp shade encases the focusing ring.

17. The integrated LED device of claim 16, wherein the lamp shade further encases a transparent covering.

18. The integrated LED device of claim 17, wherein the transparent covering abuts the focusing ring.

19. An integrated lighting device, comprising:

a housing comprising a lamp shade coupled to a base mount, the base mount coupled to a ground plug, the housing encasing an integrated LED device comprising:

an LED light source coupled to a base, the base comprising a first arm and a second arm, the first arm and the second arm each comprising trapezoids with hollow portions;

springs configured to couple with each of the first arm and the second arm to hold the base in place;

a controller coupled to a bottom portion of the base;

a switch coupled to the controller, the switch toggling the controller;

a controller box comprising an aperture coupled to the base, the controller box encasing the controller and a portion of the switch, an actuator of the switch extending through the aperture, the actuator adjusting a power output of the LED light source within a range of 200-600 lumens with each press;

an electrical coupler coupled to a recess of the controller box;

a lens holder coupled to a top portion of the base;

a lens coupled to the lens holder; and a focusing ring coupled to the top portion of the base, the focusing ring encasing the lens, the lens holder, and the LED light source.

* * * * *